United States Patent [19]

Wendling et al.

[11] Patent Number: 5,060,815

[45] Date of Patent: Oct. 29, 1991

[54] TRANSPORT AND STORAGE CONTAINER FOR FLUENT MATERIAL

[75] Inventors: Bruno Wendling; Andre Hamm, both of Drulingen, France

[73] Assignee: Sotralentz S. A., Drulingen, France

[21] Appl. No.: 450,840

[22] Filed: Dec. 14, 1989

[30] Foreign Application Priority Data

Feb. 5, 1989 [DE] Fed. Rep. of Germany ..... 3903392

[51] Int. Cl.[5] ..... B65D 19/00

[52] U.S. Cl. ..... 220/401; 220/1.5; 220/405; 220/491

[58] Field of Search ..... 220/1.5, 19, 401, 485, 220/491

[56] References Cited

U.S. PATENT DOCUMENTS

| | | | |
|---|---|---|---|
| 902,038 | 10/1908 | Wood | 220/485 X |
| 2,964,211 | 12/1960 | Pfeffer | 220/19 |
| 4,173,289 | 11/1979 | Nesti | 220/19 X |
| 4,795,057 | 1/1989 | Jungels et al. | 220/19 X |
| 4,909,387 | 3/1990 | Schutz | 220/19 X |

*Primary Examiner*—Steven M. Pollard
*Attorney, Agent, or Firm*—Herbert Dubno; Andrew Wilford

[57] ABSTRACT

A transport and storage container for flowable materials comprises an annular and erect outer wall member in the form of a gridwork of horizontal rods and vertical bars and having a lower edge, a generally planar floor member having an outer edge at the lower edge of the wall member and formed as a gridwork of horizontal bars not unitary with any of the bars of the wall member, and an inner vessel composed of a plastic material enclosed by the outer support member and supported on the bottom member. The bars of the planar floor member are separate from and not unitary with the bars of the wall member and the rods of at least one of the members have L-shaped end extensions that extend past the respective edge and are joined to the rods of the other member by welds. The upper edge of the wall member is provided with an annular collar formed by a profiled steel element welded to the tops of the steel vertical rods.

7 Claims, 2 Drawing Sheets

TRANSPORT AND STORAGE CONTAINER FOR FLUENT MATERIAL

FIELD OF THE INVENTION

The present invention relates to a transport and storage container. More particularly this invention concerns such a container for use with fluent material, that is a liquid or particles.

BACKGROUND OF THE INVENTION

A storage and/or transport container for fluent material is known which comprises an erect and annular side wall and a flat and horizontal bottom wall joined together at the outer edge of the bottom wall and lower edge of the side wall to form an upwardly open vessel, and a flexible bag or bladder within this vessel that lies against its inner surface and that itself contains the material being transported or stored. The side and bottom walls are typically made of round-section metal bars or rods that are spot-welded together in a cross-crossed gridwork with the bars welded at the intersections. It is also possible to use profiled bars and is in fact standard to provide a profiled rim element around the upper edge of the side wall. Frequently extra bars are integrated into the bottom or side wall for increased localized stiffness.

In U.S. patent application 07/422,390 filed 16 Oct. 1989 by G. Roser et al the vertical rods of the side wall are bent over into the plane of the floor panel so that they form this bottom panel, additional reinforcement bars being added for stiffness if desired. The bent-over bars and the laid-in bars are welded together. This make a very stable package that very safely contains the contained bladder. Such an arrangement can be built relatively easily even by automated procedures.

Another system described in German patent document 3,839,999 is of substantially simpler construction. In it the side wall and the bottom wall are formed of a single planar barmesh section. L-section splice elements are welded at the corners between the side wall and bottom wall. This container can be built relatively easily by wholly automated equipment.

OBJECTS OF THE INVENTION

It is therefore an object of the present invention to provide an improved two-part storage and transport container.

Another object is the provision of such an improved two-part storage and transport container which is as strong as the above-described systems but which is substantially easier to manufacture.

SUMMARY OF THE INVENTION

The instant invention is a variation on a transport and storage container for flowable materials comprising an annular and erect outer wall member in the form of a gridwork of horizontal rods and vertical bars and having a lower edge, a generally planar floor member having an outer edge at the lower edge of the wall member and formed as a gridwork of horizontal bars, and an inner vessel composed of a plastic material enclosed by the outer support member and supported on the bottom member. According to this invention the bars of the planar floor member are separate from and not unitary with the bars of the wall member and the rods of at least one of the members have L-shaped end extensions that extend past the respective edge and are joined to the rods of the other member by welds. The upper edge of the wall member is normally provided with an annular collar formed by a profiled steel element welded to the tops of the steel vertical rods.

In accordance with this invention the L-shaped extensions are unitary with the vertical rods of the wall member and are joined to the horizontal rods of the floor member. It is also possible for the extensions to be unitary with the horizontal rods of the floor member and to be joined to the vertical rods of the wall member. In another arrangement every other vertical rod of the wall member has such an extension welded to a respective horizontal rod of the floor member and every other horizontal rod of the floor member has such an extension welded to a respective vertical rod of the wall member. The type of welding unit used to make the structure can determine which style to use.

It is also possible according to this invention for the floor member to be provided with pallet-type feet element. These can be blocks welded to the bottom of the floor member or can be integral gridwork feet formed unitarily from the rods or welded to the rods of the floor member as in the above-described copending patent application.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with referenced to one figure but identical to those of another refer to structure that is functionally if not structurally identical. In the accompanying drawing.

SPECIFIC DESCRIPTION

Figure 1:
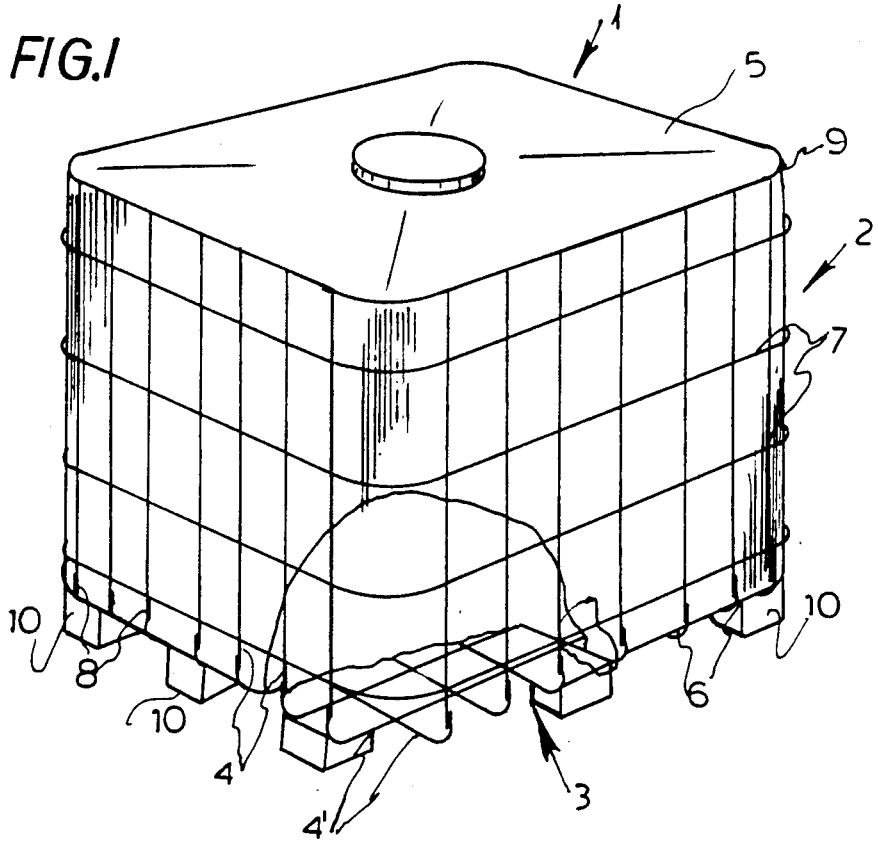
FIG. 1 is a small-scale perspective view of the container according to this invention.
Figure 2:
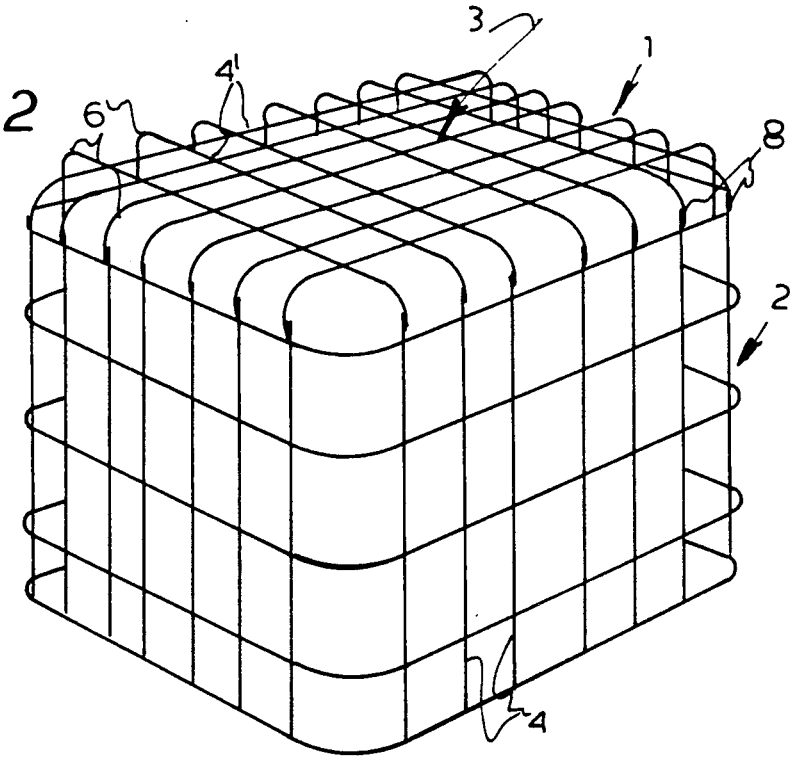
FIG. 2 is a perspective view of the wall member of FIG. 1 upside-down.

As seen in FIGS. 1 and 2 a transport/storage container 1 according to this invention basically comprises an annular side or wall member 2, a floor member 3, and a bag liner 5. The wall member 2 is formed of annular horizontal bars or rods 7 and vertical rods 4 that are connected together in a gridwork and welded together at their crossings. The floor member 3 is comprised of horizontal rods 4' also connected together in a gridwork and welded together at their crossings.

A profiled reinforcement member 9 is welded to the tops of the vertical rods 4. In addition blocks 10 (shown only in FIG. 1) can be installed at the corners and middles of the sides of the floor member 3 to allow the system to be handled like a pallet. These blocks 10 can be formed integrally of the rods 4' of the floor 3 or can be separate elements. For clarity of view, fewer rods 4 and 4' are shown than are actually normally used.

In FIGS. 1 and 2 the rods 4' of the floor 3 have curved generally L-shaped extensions 6 each of whose lower leg is unitary with and a continuation of the respective rod 4' and each of whose upper legs is welded at 8 to a respective one of the vertical rods 4 of the side member 2.

Figure 3:
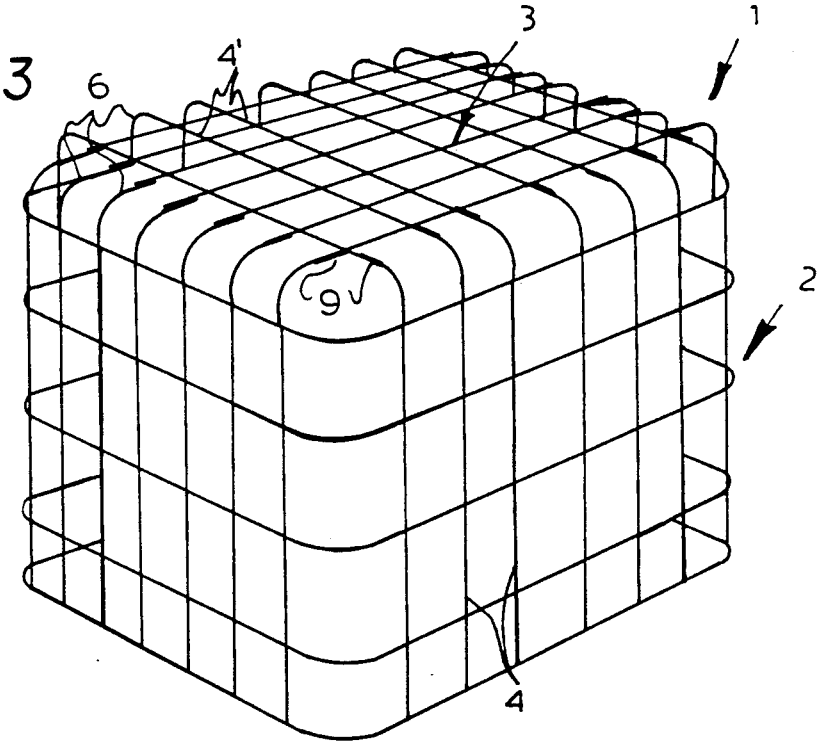
FIGS. 3 and 4 are views like FIG. 2 of variations on the system of this invention.
Figure 4:
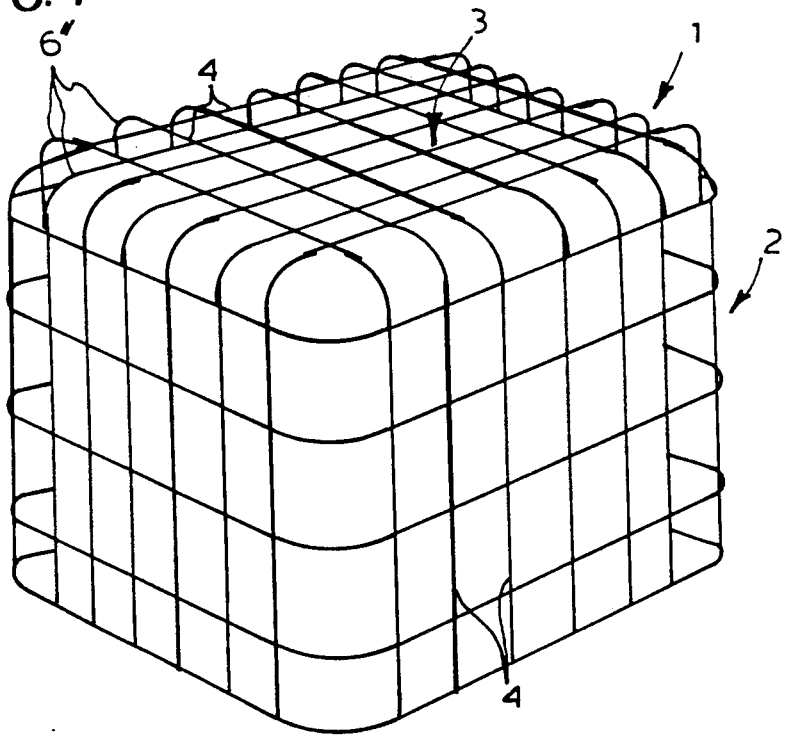

The system of FIG. 3 has corner extensions 6' that are unitary with the side-wall rods 4 and welded at 9 to the bottom-wall rods 4'. In FIG. 4 extensions 6" are formed alternately of the rods 4 and 4'.

We claim:

1. In a transport and storage container for flowable materials comprising:

an annular and erect outer wall member in the form of a gridwork of horizontal rods and vertical bars and having a lower edge;

a generally planar floor member having an outer edge at the lower edge of the wall member and formed as a gridwork of horizontal bars; and an inner vessel composed of a plastic material enclosed by the outer support member and supported on the floor member;

the improvement wherein the bars of the planar floor member are separate from and not unitary with the bars and rods of the wall member;

each bar of the wall member is in substantial vertical alignment with a respective one of the bars of the floor member; and the bars of at least one of the members are unitarily formed with L-shaped end extensions that extend past the respective edge and lie against and are joined to the respective bars of the other member by welds.

2. The improved transport/storage container defined in claim 1 wherein the L-shaped extensions are unitary with the horizontal bars of the floor member.

3. The improved transport/storage container defined in claim 1 wherein the L-shaped extensions are unitary with the vertical bars of the wall member.

4. The improved transport/storage container defined in claim 1 wherein every other vertical bar of the wall member has such an extension welded to a respective horizontal bar of the floor member and every other horizontal bar of the floor member has such an extension welded to a respective vertical bar of the wall member.

5. The improved transport/storage container defined in claim 1 wherein the floor member is provided with pallet-type feet element.

6. A transport and storage container for flowable materials comprising:

an annular and erect outer wall member in the form of a gridwork of horizontal rods and vertical bars and having a lower edge, each wall-member bar being unitarily formed with a horizontal extension leg extending horizontally inward from the lower edge;

a generally planar floor member having an outer edge at the lower edge of the wall member and formed as a gridwork of horizontal bars not unitary with the bars and rods of the wall member, each bar of the wall member being in substantial vertical alignment with a respective one of the bars of the floor member and each leg lying against the respective floor-member bar;

respective welds securing the horizontal extension legs to the respective floor-member bars; and an inner vessel composed of a plastic material enclosed by the outer support member and supported on the floor member.

7. A transport and storage container for flowable materials comprising:

an annular and erect outer wall member in the form of a gridwork of horizontal rods and vertical bars and having a lower edge;

a generally planar floor member having an outer edge at the lower edge of the wall member and formed as a gridwork of horizontal bars not unitary with the bars and rods of the wall member, each bar of the wall member being in substantial vertical alignment with a respective one of the bars of the floor member and being unitarily formed with a vertical extension leg extending upward from the outer edge and lying against the respective wall-member bar;

respective welds securing the vertical extension legs to the respective wall-member bars; and an inner vessel composed of a plastic material enclosed by the outer support member and supported on the floor member.

* * * * *